US008496320B2

(12) United States Patent
Foster et al.

(10) Patent No.: US 8,496,320 B2
(45) Date of Patent: Jul. 30, 2013

(54) INK CARTRIDGE HAVING A STAKED VENT SEALING MEMBER

(75) Inventors: Ernest Foster, Corvallis, OR (US); Michael E. Goodale, Corvallis, OR (US)

(73) Assignee: Hewlett-Packard Development Company, L.P., Houston, TX (US)

( * ) Notice: Subject to any disclaimer, the term of this patent is extended or adjusted under 35 U.S.C. 154(b) by 37 days.

(21) Appl. No.: 12/941,801

(22) Filed: Nov. 8, 2010

(65) Prior Publication Data

US 2011/0050820 A1 Mar. 3, 2011

Related U.S. Application Data

(63) Continuation of application No. PCT/US2008/062989, filed on May 8, 2008.

(51) Int. Cl.
*B41J 2/175* (2006.01)

(52) U.S. Cl.
USPC ..... 347/86; 347/85

(58) Field of Classification Search
USPC ..... 347/85, 86
See application file for complete search history.

(56) References Cited

U.S. PATENT DOCUMENTS

| | | | | |
|---|---|---|---|---|
| 5,442,384 | A | 8/1995 | Schantz et al. | |
| 5,469,199 | A | 11/1995 | Allen et al. | |
| 5,600,354 | A | 2/1997 | Hackleman et al. | |
| 6,276,786 | B1 * | 8/2001 | Eida et al. | 347/86 |
| 6,345,889 | B1 | 2/2002 | Sakuraoka et al. | |
| 6,634,732 | B2 | 10/2003 | Farr et al. | |
| 2007/0229630 | A1 * | 10/2007 | Komplin | 347/87 |
| 2008/0218567 | A1 * | 9/2008 | Silverbrook et al. | 347/86 |

FOREIGN PATENT DOCUMENTS

| | | |
|---|---|---|
| CN | 2516345 | 10/2002 |
| EP | 0741038 | 11/1996 |
| EP | 0792749 | 9/1997 |
| EP | 1499666 | 8/2004 |
| JP | 1995076101 | 3/1995 |
| JP | 1997290516 | 11/1997 |
| JP | 10-250095 | 9/1998 |
| JP | 1998258519 | 9/1998 |
| JP | 2002-103577 | 4/2002 |
| KR | 930021385 | 11/1993 |

OTHER PUBLICATIONS

PCT/US2008/062989 International Search Report.

* cited by examiner

*Primary Examiner* — Jannelle M Lebron

(57) ABSTRACT

An ink cartridge includes a body that is adapted to contain ink, an air vent provided on the body adapted to enable air to pass into and out of the body, and a sealing member that covers the air vent, the sealing member being heat staked to the body.

18 Claims, 5 Drawing Sheets

INK CARTRIDGE HAVING A STAKED VENT SEALING MEMBER

CROSS-REFERENCE TO RELATED PATENT APPLICATIONS

The present application is a continuation of co-pending PCT/US2008/062989 filed on May 8, 2008 by Ernest Foster and Michael E. Goodale and entitled INK CARTRIDGES HAVING HEAT-STAKED VENT SEALING MEMBERS, the full disclosure of which is hereby incorporated by reference

BACKGROUND

Ink cartridges used in inkjet printers typically comprise a vent that allows air to enter the cartridge as ink is drawn from the cartridge. The passage of such air into the cartridge avoids the creation of a vacuum within the cartridge and, therefore, facilitates the flow of ink from the cartridge.

The vent of an ink cartridge is normally sealed prior to use to avoid evaporation of the ink contained within the cartridge and leakage from the vent due to pressure changes during shipment. In some cases, the vent is covered by a sealing member that the end user removes prior to installing the cartridge within a printer. Often, such sealing members are held in place with pressure sensitive adhesive. Unfortunately, such adhesive exhibits high rates of failure, particularly when the adhesive is exposed to higher temperatures and/or altitudes. When the adhesive fails, air can then enter the cartridge and dry out the ink that the cartridge contains.

BRIEF DESCRIPTION OF THE DRAWINGS

The disclosed ink cartridges can be better understood with reference to the following drawings. The components in the drawings are not necessarily to scale.

DETAILED DESCRIPTION

As described above, ink cartridge vents may be sealed using a sealing member that is attached to the cartridge with pressure sensitive adhesive. Unfortunately, use of pressure sensitive adhesive can be accompanied by high rates of failure, particularly when the adhesive is exposed to higher temperatures and/or altitudes. As described in the following, however, lower rates of failure can be achieved when the sealing member is heat staked to the cartridge. Because the heat staking process can raise the temperature of air contained within the cartridge and therefore can cause that air to expand, heat staking may be performed in a multi-stage process in which the vent is not fully sealed until a final stage of heat staking. In such a case, air may escape from the cartridge during the heat staking process. In some embodiments, heat stake elements used in the heat staking process maintain air gaps between the sealing member and the cartridge that provide pathways for the air to escape.

Figure 1:
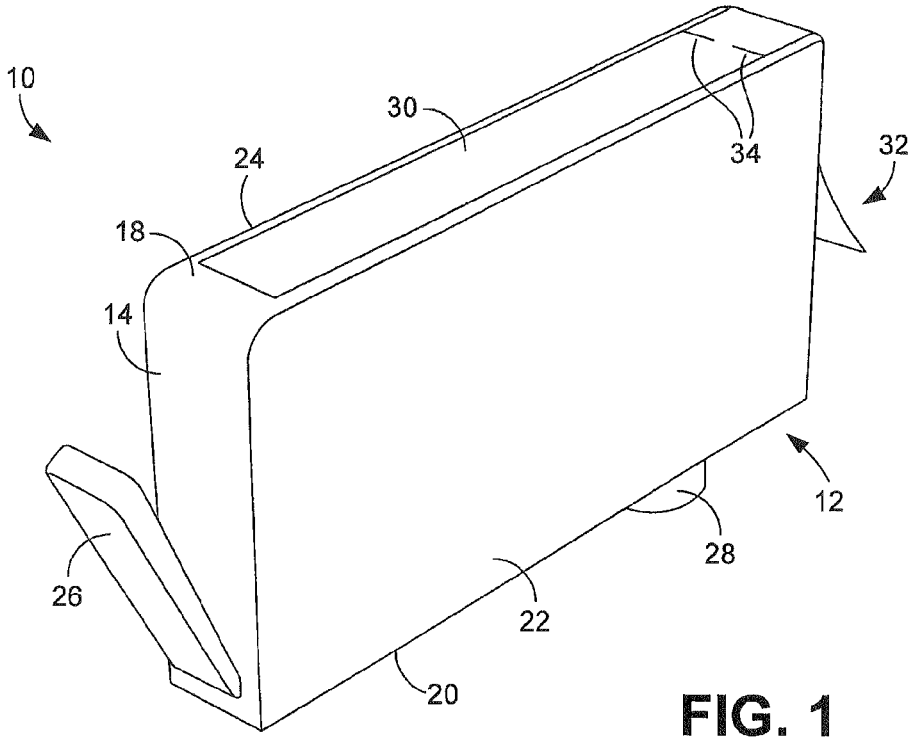
FIG. 1 is a front perspective view of an embodiment of an ink cartridge that includes a heat-staked vent sealing member.
Figure 2:
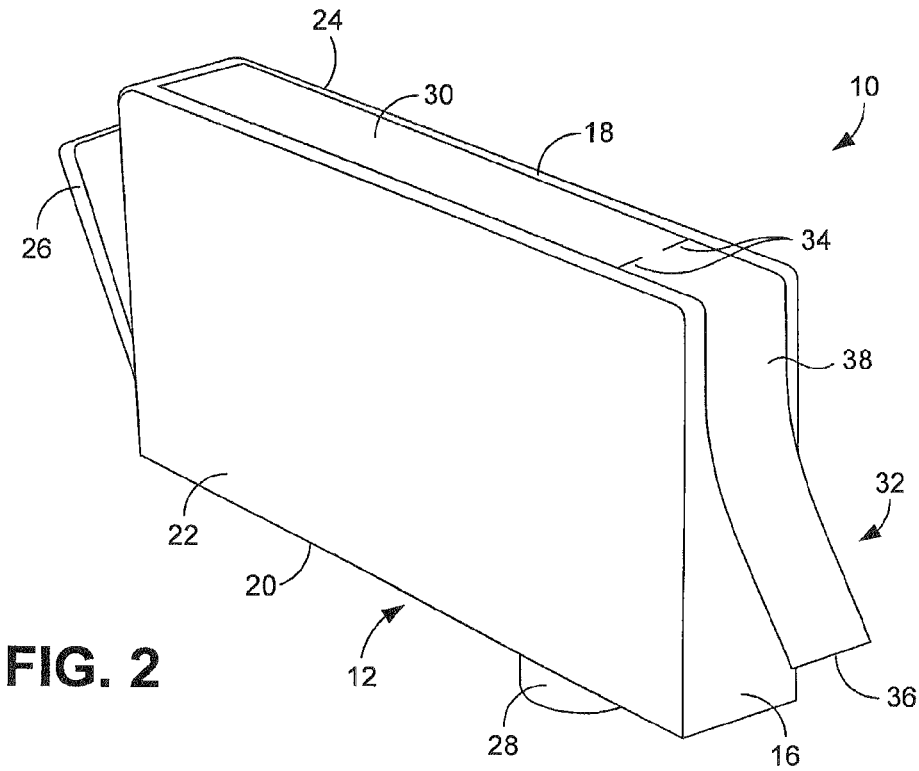
FIG. 2 is a rear perspective view of the ink cartridge of FIG. 1.

Turning now to the figures, in which like numerals identify corresponding parts, illustrated in FIGS. 1 and 2 is an embodiment of an ink cartridge 10 that is configured to contain and supply ink to a printing device, such as a printer. As indicated in those figures, the ink cartridge 10 comprises a polymeric body 12 that, for example, is formed through injection molding. The body 12 includes a front side 14, a rear side 16, a top side 18, a bottom side 20, and opposed lateral sides 22 and 24. Extending upward from the bottom end of the front side 14 is a finger tab 26 that may be used to insert the cartridge 10 into and/or remove the cartridge from a printing device. Extending downward from the bottom side 20 is an ink outlet 28 from which ink may be drawn from the cartridge 10.

With further reference to FIGS. 1 and 2, shown applied to the surfaces of the top side 18 and a portion of the rear side 16 is a sealing member 30 that is used to seal an air vent (not visible in FIGS. 1 and 2) provided on the top side of the cartridge 10 that enables air to enter and exit the cartridge. In some embodiments, the sealing member 30 is printed upon with various indicia, such that the sealing member also functions as a label. Examples of indicia that may be printed upon the sealing member 30 include indications of the cartridge manufacturer, the cartridge model number, the cartridge manufacturing date, and the like. By way of example, the sealing member 30 comprises a thin strip of polymeric material.

As described below, the sealing member 30 is heat staked to the cartridge 10. More particularly, the sealing member 30 is heat staked to the surface of the top side 18 at discrete locations. In addition, the sealing member 30 is adhered to the cartridge 10 with adhesive. In some embodiments, thermal adhesive is provided along the entire length of the sealing member 30 and pressure sensitive adhesive is provided at discrete locations that do not coincide with an air vent described below. As is further illustrated in FIGS. 1 and 2, the sealing member 30 further includes tear slits 34 that facilitate intentional tearing of the sealing member at a predetermined point along its length to expose the vent to the ambient air. The portion of the sealing member 30 that extends from its end 36 to the tear slits 34 therefore comprises a tear-away portion 38 of the sealing member that may be removed by the user prior to use of the cartridge 10. By way of example, the tear-away portion 38 is torn away using an end portion 32 of the sealing member 30 that is not adhered to the cartridge 10 and, therefore, serves as a pull tab.

Figure 3:
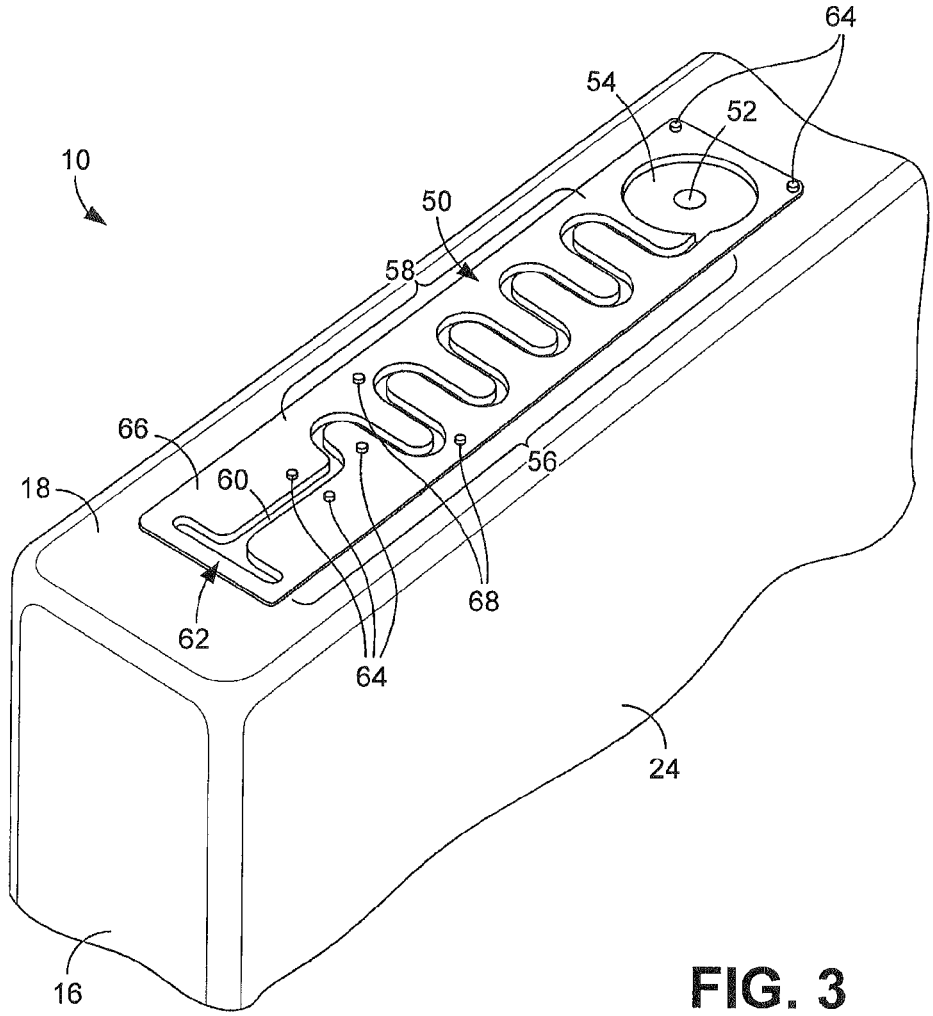
FIG. 3 is a partial rear perspective view of the ink cartridge of FIGS. 1 and 2, illustrating an embodiment of an air vent of the cartridge prior to being covered by a sealing member.

FIG. 3 illustrates an example embodiment of an air vent 50 provided on the top side 18 of the cartridge 10. As shown in FIG. 3, the vent 50 comprises a labyrinth vent that includes a vent opening 52 provided within a circular recess 54 that is in fluid communication with an elongated vent channel 56. The channel 56 comprises a serpentine channel section 58 that extends from the recess 54 to an linear channel section 60. The channel 56 terminates in a T-shaped end 62 that, as described below, is exposed when the tear-away portion 38 of the sealing member 30 is removed by the end user.

As is further shown in FIG. 3, multiple heat stake elements 64 are provided on a surface 66 that defines the upper edges of the circular recess 54 and the vent channel 56. In the illustrated embodiment, the heat stake elements 64 comprise small cylindrical elements that are unitarily formed with the top side 18 of the cartridge 10. Although cylindrical elements have been illustrated and described, it is to be understood that the heat stake elements 64 may comprise other shapes, including cones, rounded domes, ribs, and the like. In some embodiments, the heat stake elements 64 are approximately 30 to 500 microns (μm) tall. By way of example, the heat stake elements 64 are approximately 200 μm tall.

The example cartridge 10 shown in FIG. 3 comprises seven heat stake elements 64, including a first pair of elements positioned on opposite sides of the circular recess 54, a second pair of elements positioned on opposite sides of the linear channel section 60, a lone element positioned within the last curve of the serpentine channel section 58 prior to the linear channel section, and a pair of elements 68 that are positioned on opposite sides of an intermediate portion of the serpentine channel section. It is noted that greater or fewer heat stake elements 64 can be used/or can be positioned in alternative position as required for the particular cartridge application. As described below, the heat stake elements 68 may be the last elements to be bonded to the sealing member 30, in which case the elements 68 enable venting of air out from the cartridge 10 during previous stages of the heat staking process.

Figure 4:
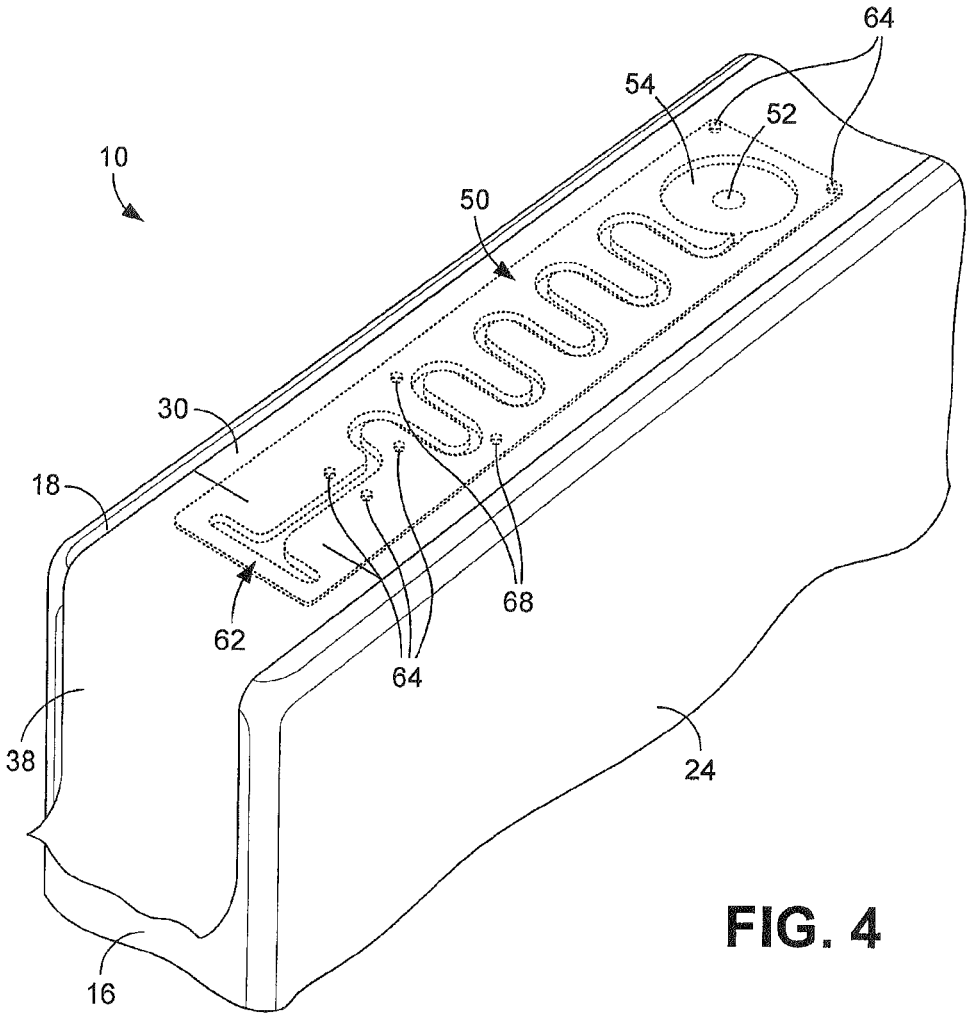
FIG. 4 is a further partial rear perspective view of the ink cartridge of FIG. 3, illustrating the cartridge after the air vent has been covered by a sealing member.

FIG. 4 illustrates the sealing member 30 in place over the air vent 50 prior to heat staking. At that point, the sealing member 30 is adhered to the top side 18 and the rear side 16 of the cartridge 10 and covers both the circular recess 54 and the vent channel 60, including the T-shaped end 62. Notably, the sealing member 30 is not adhered to the cartridge along its entire length. Instead, at least in some embodiments, the portion of the sealing member 30 that overlies the air vent 50 is not adhered to the cartridge 10 because that portion of the member only comprises thermal adhesive that has not yet been heated. However, other portions of the sealing member 30, including part of the tear-away portion 38 and the remainder of the sealing member that overlies the top side 18 (i.e., between the air vent 50 and the front side 14) is adhered to the cartridge 10 due to the presence of the pressure sensitive adhesive that is provided on the underside of the member. Therefore, the pressure sensitive adhesive holds the sealing member 30 in place until heat staking is performed.

Figure 5C:
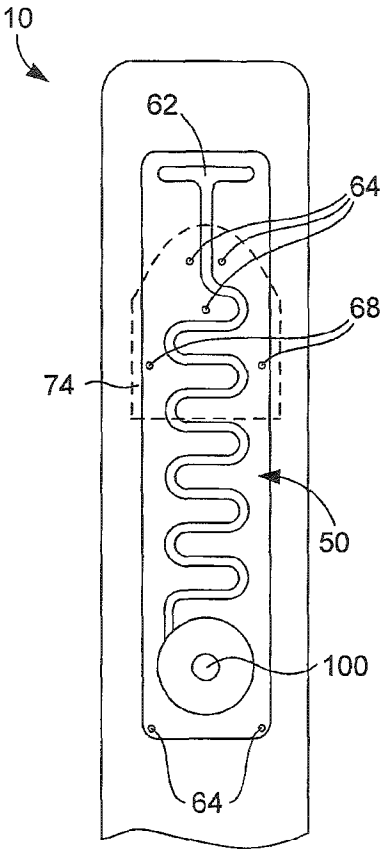
FIGS. 5A-5C are partial top views of the ink cartridge of FIG. 3, depicting multiple stages of a heat staking process in which the sealing member is heat staked to the cartridge.
Figure 5B:
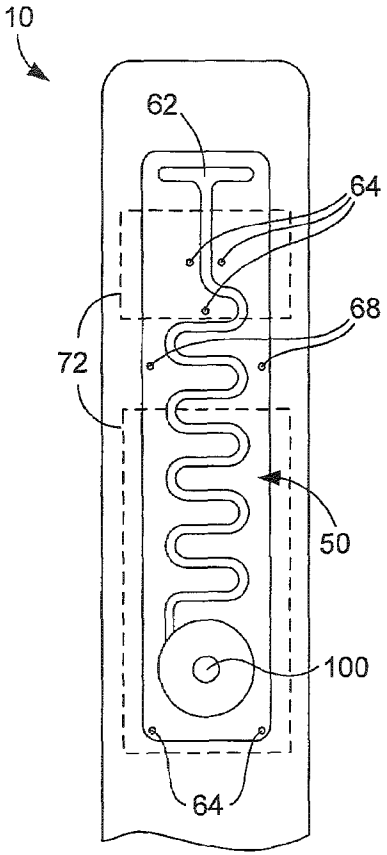
Figure 5A:
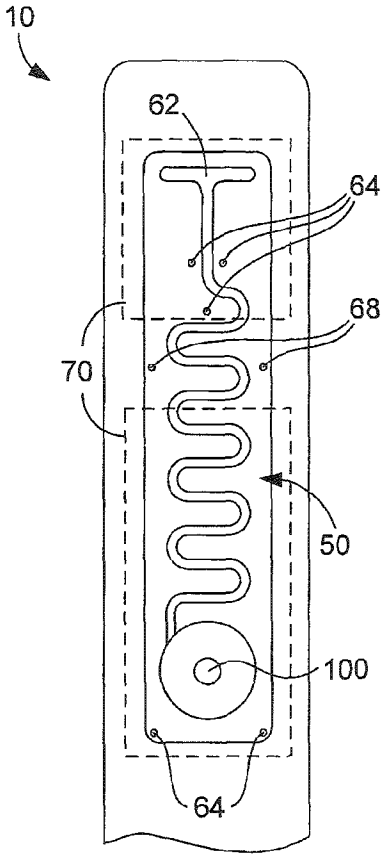
Figure 6:
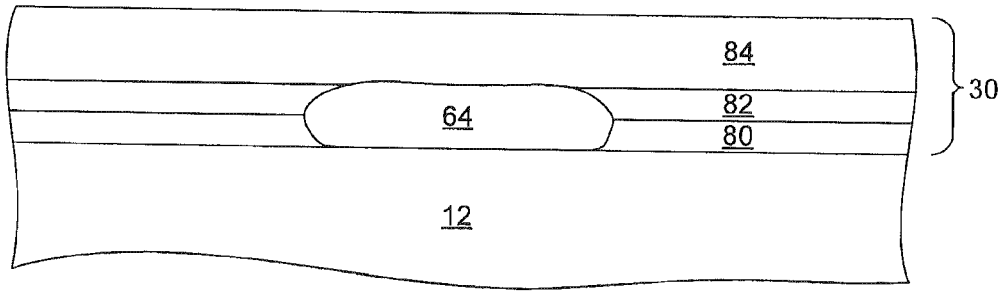
FIG. 6 is a partial side view of the cartridge of FIG. 3, depicting a heat stake element bonded to the sealing member.

Once the sealing member 30 has been attached to the cartridge 10, it can be further secured to the cartridge using a heat staking process. FIGS. 5A-5C depict various stages of a multi-stage heat staking process in which multiple heat staking dies are brought into contact with the cartridge 10 and its sealing member 30. More particularly, illustrated in FIGS. 5A-5C are outlines of the footprints of three different dies to identify the heat stake elements 64, 68 upon which they act. Referring first to FIG. 5A, a first die 70 is used to apply heat to the three heat stake elements 64 closest to the T-shaped end 62 and the two heat stake elements circular recess 54. Notably, the die 70 does not overlap the heat stake elements 68 and, therefore, no heat is applied to those elements. When heat is applied to the heat stake elements 64, the thermal adhesive is activated and the sealing member 30 adheres to the top side 18 of the cartridge 10. In addition, the heat stake elements 64 melt and therefore bond to the sealing member 30. More particularly, the elements 64 bond to a substrate of the sealing member 30. Such bonding is depicted in FIG. 6, in which a heat stake element 64 is shown passing through a thermal adhesive layer 80 and a peeling layer 82 of the sealing member 30 to the substrate 84 of the sealing member.

Figure 7:
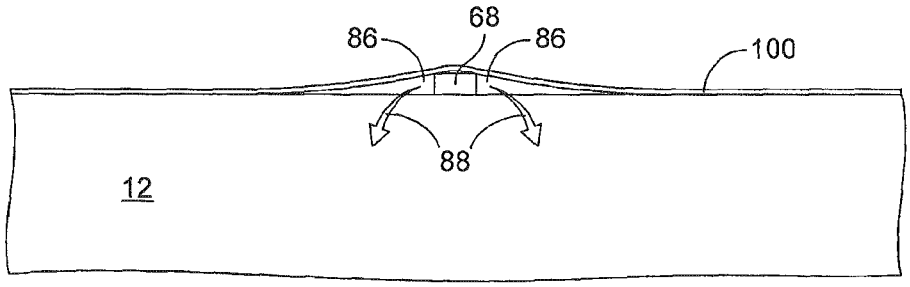
FIG. 7 is a further partial side view of the ink cartridge of FIG. 3, illustrating the cartridge after a second stage of heat staking depicted in FIG. 5B has been performed.

With reference next to FIG. 5B, a second die 72 is used to apply heat to the same heat stake elements 64 that were heated in the stage depicted in FIG. 5A. Again, the die 72 does not overlap the heat stake elements 68 and, therefore, no heat is applied to those elements. Because heat was not applied to the heat stake elements 68 in either of the stages depicted in FIGS. 5A and 5B, those elements were not bonded to the sealing member 30 and the thermal adhesive adjacent to those elements was not activated. Because the heat stake elements 68 extend up from the surface 66 of the top side 18, they support the sealing member 30 above that surface, thereby forming air gaps through which air within the cartridge 10 that expands during the first two stages of heat staking can escape. Such a configuration is depicted in FIG. 7. As shown in that figure, the heat stake element 64 forms air gaps 86 through which air can escape, as indicated by arrows 88.

With reference next to FIG. 5C, a third heat staking die 74 can then be applied to the cartridge 10 that overlaps the three heat stake elements 64 closest to the T-shaped end 62, as well as the heat stake elements 68. After that final stage of heat staking, the sealing member 30 is hermetically sealed to the cartridge 10 and therefore prevents the ingress or egress of air into or out of the cartridge via the vent 50.

Figure 8:
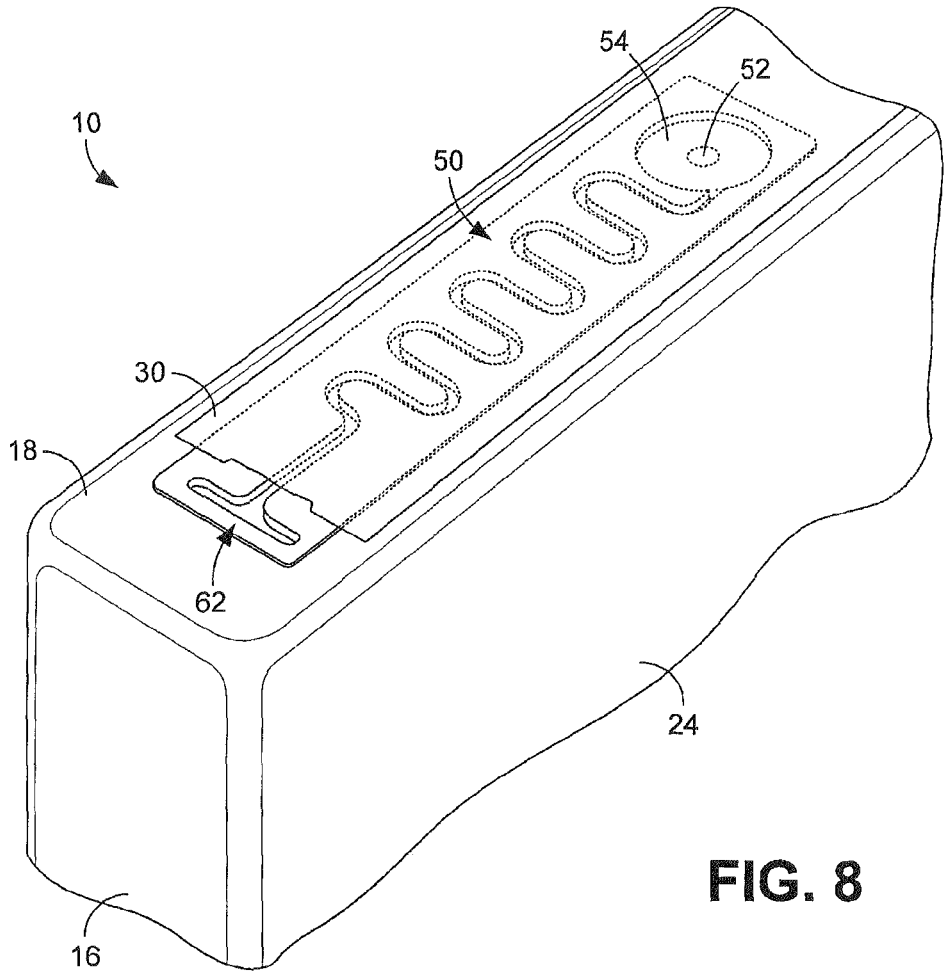
FIG. 8 is a further partial rear perspective view of the ink cartridge of FIG. 3, illustrating exposure of the air vent after a tear-off portion of the sealing member has been removed.

At this point, the manufacturing of the cartridge 10 is completed and the cartridge can be provided to an end user for use in a printing device. To enable such usage, the user will remove the tear-away portion 38 of the sealing member 30 first illustrated in FIG. 2. In particular, the user can pull the end portion (pull tab) 32 of the sealing member 30 and peel the member off of the rear side 16 and part of the top side 18 of the cartridge 10 against the bonding force of the pressure sensitive and thermal adhesive. Once the portion of the sealing member 30 that has been removed from the cartridge 10 extends to the tear slits 18, further pulling results in the tear-away portion 46 separating from the remainder of the sealing member, thereby exposing the T-shaped end 62 of the vent channel 56, as illustrated in FIG. 8. Through such exposure, air can travel through the channel 56 and to the vent opening 54.

The invention claimed is:

1. An ink cartridge comprising:

a body to contain ink;

an air vent provided on the body to enable air to pass into and out of the body; and a sealing member that covers the air vent, the sealing member having a removable first part attached to the body to cover one part of the air vent and a non-removable second part heat staked to the body to cover another part of the air vent, wherein the non-removable second part of the sealing member is heat staked to the body with heat stake elements extended from a surface of the body.

2. The ink cartridge of claim 1, wherein:

the body comprises a polymeric body; and the non-removable second part of the sealing member is heat staked to the polymeric body with the heat stake elements melted into the sealing member.

3. The ink cartridge of claim 1, wherein the air vent comprises an air opening in the body and a serpentine vent channel that extends from the air opening, the removable first part of the sealing member to cover a portion of the serpentine vent channel away from the air opening and the non-removable second part of the sealing member to cover the air opening and a portion of the serpentine vent channel near the air opening.

4. The ink cartridge of claim 1, wherein the sealing member comprises a multi-layer sealing member and the heat stake elements are melted into one or more but not all of the layers of the sealing member.

5. The ink cartridge of claim 1, wherein the heat stake elements form air gaps between the body and the sealing member.

6. The ink cartridge of claim 1, wherein the heat stake elements are positioned in close proximity to the air vent.

7. The ink cartridge of claim 1, wherein the heat stake elements are positioned on opposite sides of a vent channel of the air vent.

8. The ink cartridge of claim 1, wherein the removable first part of the sealing member is attached to the body with at least a pressure sensitive adhesive.

9. The ink cartridge of claim 1, wherein the non-removable second part of the sealing member is further attached to the body with a thermal adhesive.

10. An ink cartridge comprising:

a body to contain ink, the body having a top side;

a vent formed into the top side of the body adapted to enable air to pass into and out of the body, the vent comprising a vent opening and a vent channel extending from the vent opening; and a sealing member that covers the vent, the sealing member having a removable first part attached to the body to cover the vent channel away from the vent opening and a non-removable second part heat staked to the body to cover the vent opening and the vent channel near the vent opening, wherein the non-removable second part of the sealing member is heat staked to the body with heat stake elements protruded from the top side of the body.

11. The ink cartridge of claim 10, wherein the removable first part of the sealing member is attached to the body with at least a pressure sensitive adhesive.

12. The ink cartridge of claim 10, wherein the non-removable second part of the sealing member is further attached to the body with a thermal adhesive.

13. The ink cartridge of claim 10, wherein the removable first part of the sealing member can be torn away from the ink cartridge by a user to expose the vent channel away from the vent opening.

14. The ink cartridge of claim 10, wherein the heat stake elements are unitarily formed with the top side of the body.

15. The ink cartridge of claim 10, wherein the heat stake elements form air gaps between the top side of the body and the sealing member.

16. The ink cartridge of claim 10, wherein the vent channel has a T-shaped end, and wherein the heat stake elements include at least one pair of heat stake elements aligned on opposite sides of the T-shaped end and at least one heat stake element positioned along the vent channel before the T-shaped end.

17. The ink cartridge of claim 10, wherein the heat stake elements include at least one pair of heat stake elements aligned on opposite sides of the vent channel of the vent.

18. The ink cartridge of claim 17, wherein the heat stake elements further include at least another pair of heat stake elements positioned in close proximity to the vent opening of the vent.

* * * * *

UNITED STATES PATENT AND TRADEMARK OFFICE

CERTIFICATE OF CORRECTION

PATENT NO. : 8,496,320 B2
APPLICATION NO. : 12/941801
DATED : July 30, 2013
INVENTOR(S) : Foster et al.

It is certified that error appears in the above-identified patent and that said Letters Patent is hereby corrected as shown below:

In the claims

In column 5, line 22, in Claim 10, delete "body adapted" and insert -- body --, therefor.

Signed and Sealed this
Nineteenth Day of November, 2013

Teresa Stanek Rea
*Deputy Director of the United States Patent and Trademark Office*